United States Patent [19]

Chromy

[11] 4,222,443

[45] Sep. 16, 1980

[54] MOTOR-DRIVEN HAMMER DRILL

[75] Inventor: Franz Chromy, Levis, Austria

[73] Assignee: Hilti Aktiengesellschaft, Schaan, Liechtenstein

[21] Appl. No.: 58,839

[22] Filed: Jul. 19, 1979

[30] Foreign Application Priority Data

Jul. 21, 1978 [DE] Fed. Rep. of Germany ..... 2832169

[51] Int. Cl.[2] ..... B25D 9/26; B25D 11/12

[52] U.S. Cl. ..... 173/116; 173/14

[58] Field of Search ..... 173/116, 118, 14, 117; 60/370

[56] References Cited

U.S. PATENT DOCUMENTS

| | | | |
|---|---|---|---|
| 2,622,399 | 12/1952 | Babitch | 60/370 |
| 2,748,561 | 6/1956 | Goodridge | 60/370 |
| 3,835,935 | 9/1974 | Sides et al. | 173/14 |
| 3,921,729 | 11/1975 | Schmuck | 173/14 |

*Primary Examiner*—Werner H. Schroeder
*Assistant Examiner*—Andrew M. Falik
*Attorney, Agent, or Firm*—Toren, McGeady and Stanger

[57] ABSTRACT

In a hammer drill, a drive piston is reciprocated by a motor, and, over a pneumatic buffer, the reciprocating motion is transmitted to a percussion piston. A throttle valve regulates the flow of a fuel mixture to the motor for controlling its operation. A membrane switch connected to and operated by the pressure conditions within the pneumatic buffer controls the throttle valve.

8 Claims, 2 Drawing Figures

MOTOR-DRIVEN HAMMER DRILL

SUMMARY OF THE INVENTION

The present invention is directed to a hammer drill containing a cylinder which guides a motor-driven drive piston and a percussion piston. A pneumatic buffer is located between the drive piston and the percussion piston and moves the percussion piston back and forth as the motor reciprocates the drive piston.

In known hammer drills, percussion energy is supplied to a tool held in the hammer drill and the percussion energy is supplied to the tool via a pneumatically driven percussion piston. In addition, the tool can also be rotated so that the combination of the rotation and percussion make it possible to achieve a maximum drilling power.

In most cases, an electric motor or an internal combustion motor is used as the power source in a hammer drill. A characteristic feature of both of these types of motors is that there rates of rotation are dependent on the load, for instance, a reduction in the load results in an increase in the rate of rotation of the motor.

In known hammer drills this phenomenon causes the following problems. During hammer drill operation, the tool, possibly combining both percussion and rotation, applies the percussion energy of the drill to a work surface, in which case the motor operates at on-load speed. When the application of the percussive force by the tool is interrupted for any reason, as in the case where the tool suddenly finds no resistance to its energy output, the motor accelerates to the no-lead speed. For reasons of wear, such hammer drills are constructed so that when this happens the percussion piston comes to a stop in the forward position within the hammer drill cylinder. When the tool is again directed against a work surface capable of absorbing the percussive force, the percussive piston which is still at rest, reaches the pneumatically effective range of the drive piston operated by the motor at no-load speed and, thus, again moves back and forth. Since the percussive piston is placed into movement from the high no-load speed transmitted to the drive piston, extreme peak loads occur at the driving parts, because, as experience has shown, the driving moment for the percussion mechanism significantly increases with an increase in the operating speed. In known hammers, the peak pneumatic pressure developed under such circumstances is significantly larger than the peak pressure during normal operation. Without doubt, under such conditions premature wear of the hammer drill components results.

Therefore, the primary object of the present invention is to provide a hammer drill whose motor does not significantly exceed the on-load operating conditions even when the percussion force is no longer applied.

In accordance with the present invention, the operating conditions of the drive motor are controlled based on the pressure conditions within the pneumatic buffer.

When the percussion piston is in its forward rest position within the cylinder, that is, its forwardmost position spaced from the drive piston, essentially atmospheric conditions exist within the cylinder between the percussion piston and the driving piston. However, when the percussion piston is in operation transmitting percussive force, a pneumatic buffer exists between the percussion piston and the driving piston with the pressure conditions within the buffer changing in a characteristicly alternating sequence during the reciprocating movements of the drive piston. These pressure differences effect the out-of-phase movement of the percussion piston. During the return movement of the drive piston, the buffer is characterized by a slight negative pressure and, during the forward movement of the driving piston, by a peak pressure which may reach values of above 10 bar. Accordingly, the air or buffer located between the pistons has parameters which can be used as signals for controlling the speed or operating conditions of the drive motor.

Preferably, the pressure conditions of the pneumatic buffer serve as a signal for controlling the speed of the drive motor. For example, the characteristic pressure peak of the buffer can be used as a signal, this can be effected by an appropriate arrangement of the point at which the pressure conditions are checked within the pneumatic buffer. It is advantageous, if the point at which the pressure conditions are checked is only briefly closed by the percussion piston during operation.

Preferably, the pneumatic buffer is in communication with an adjusting element which, in turn, is connected to a control device for the motor. The signal generated by the pneumatic buffer is transmitted to the adjusting element in a modified form and then to the control device for the motor. The control device may be a throttle valve in an internal combustion motor or a switch in an electric motor. Accordingly, the control sequence is selected so that the motor receives the energy supply required for operation under load when the signal is generated by the pneumatic buffer.

When the percussion piston is located in its forward rest position, the buffer no longer exists and no signal is generated. Accordingly, the adjusting element ensures that the control device for the motor is set so that the speed of the motor is throttled. When the control cycle is appropriately designed, the speed of the motor can be regulated to the on-load speed or to a lower speed when the percussion piston is in its rest position.

A membrane switch with automatic resetting is particularly suitable for use as the adjusting element. The membrane moves a connecting rod or similar member which effects the regulation of the control device.

In one proposed embodiment of the invention, a control line is provided for transmitting signals from the pneumatic buffer to the membrane switch. Accordingly, the membrane switch can be located at a distance from the cylinder containing the buffer. Furthermore, structural advantages are gained with a positive effect provided on the manipulation of the hammer drill. For example, it is possible to form the control line as a tube with a sensing core movably supported within it. It is, however, especially advantageous to utilize a hollow tubular line through which the pressure within the buffer is directly communicated as signal to the membrane switch.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
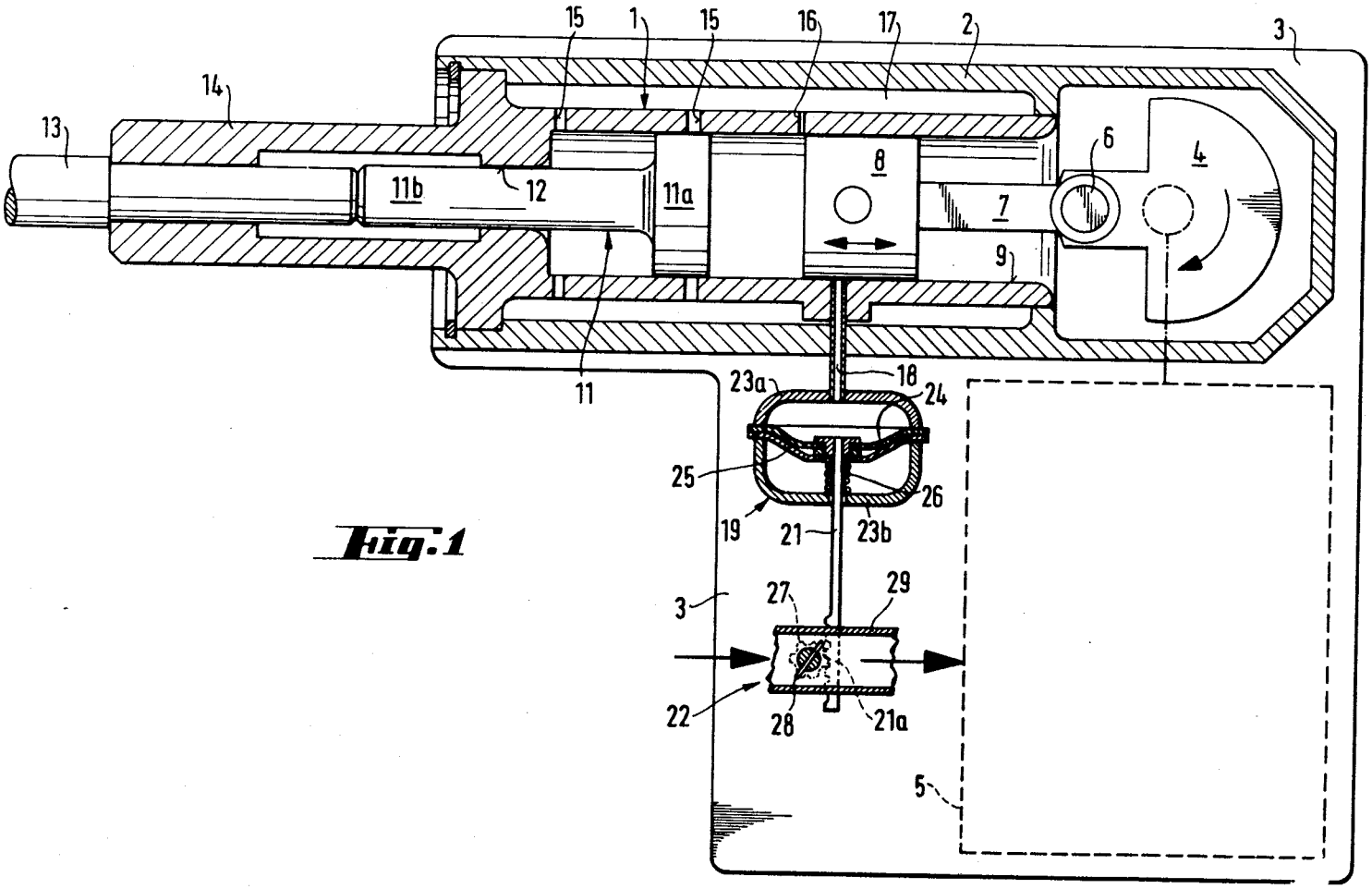
FIG. 1 is a somewhat schematic side view, partly in section of a hammer drill with its percussion piston in the operating position.

As shown in the drawings, the hammer drill consists of an axially extending cylinder 1 having a first or trailing end and a second leading end. A jacket tube 2 laterally encloses the cylinder and a housing 3 illustrated only by its outer contour encloses the jacket tube. Within the jacket tube 2, rearwardly of the first end of the cylinder, a crank 4 is rotatably supported and is driven in a known manner by an internal combustion engine 5 indicated by dashed lines with the connection between the engine and the crank shown in chain lines. Crank 4 is connected by a crank pin 6 to a connecting rod 7 secured at its forward end to a drive piston 8 so that the crank reciprocates the drive piston within the bore 9 in the cylinder. Within the bore 9, forwardly of the drive piston 8, a percussion piston 11 is located consisting of a head 11*a* which is supported in sliding contact with the bore 9 and a shank 11*b* which extends forwardly toward the second end of the cylinder through a reduced diameter bore 12. The forward end of the shank 11*b* is in contact with the rearward end of a tool 13, shown schematically. The tool is movably supported within the second end of the cylinder 1 which is constructed as a tool holder 14. In the range of movement of the head 11*a* of the percussion piston 11, openings 15 are provided through the cylinder communicating between its bore and the lateral exterior of the cylinder. In addition, a compensating opening 16 is provided through the cylinder extending between its bore and the exterior surface of the cylinder. The openings 15 and 16 communicate with an axially extending annular space 17 formed between the inner surface of the jacket tube 2 and the outer surface of the cylinder 1.

A tubular control line 18 opens at one end into the bore 9 in the cylinder and extends outwardly to a membrane switch 19. Push rod 21 extends from the membrane switch to a control member 22 in the form of a throttle valve for the fuel mixture supplied into the internal combustion engine 5.

The membrane switch 19 is formed of two half-shells 23*a*, 23*b*. A membrane 24 is fixed between the two half-shells 23*a*, 23*b* dividing the interior of the shells into two chambers. The push rod 21 is connected to the membrane so that it moves with it. A cup-shaped stop 25, located below the membrane 24 as viewed in FIGS. 1 and 2, limits the downward movement of the membrane 24. Within the half-shell 23*b*, a compression spring 26 encircles the push rod 21 and extends between the membrane and the interior surface of the half-shell. Compression spring 26 biases the membrane 24 in the upward direction away from the stop 25. The end of the push rod 21 spaced from the membrane switch 19 has a rack portion 21*a* in engagement with a gear 27 mounted on the throttle valve 28. The movement of the membrane 24 is transmitted by the push rod 21 to the throttle valve 28 and determines the flow cross-section through tubular member 29. As indicated by the arrows the fuel mixture from a carburetor, not shown, is conveyed through the tubular member 29 into the combustion chamber in the engine 5.

When the hammer drill is in the operating condition, as shown in FIG. 1, the space within the cylinder bore 9 between the head 11*a* of the percussion piston 11 and the adjacent end surface of the driving piston 8 forms a pneumatic buffer which, as a result of the reciprocating action of the driving piston 8, causes a corresponding back and forth movement of the percussion piston 11. During operation, the openings 15 prevent the formation of an air cushion within the cylinder during the forward movement of the percussion piston 11 so that the forward movement of the head 11*a* is not retarded. Moreover, during the rearward movement of the driving piston 8, the openings 15 prevent the formation of a retarding vacuum in front of the head 11*a* by the intake of air from the annular space 17. Opening 16 compensates for any leakage losses occurring at the pistons.

In FIG. 1 driving piston 8 is illustrated in its forwardmost operating position and the pneumatic buffer between the driving piston and the head 11*a* has driven the percussion piston forwardly causing it to impact against the tool 13. With continued rotation of the crank 4, the drive piston 8 is moved rearwardly and via the buffer the percussion piston is also moved rearwardly. As the drive piston 8 moves rearwardly from the position shown in FIG. 1 it uncovers the opening into the tubular control line 18 and the pressure in the pneumatic buffer is transmitted through the control line into the membrane switch 19. During the complete forward and backward stroke of the driving piston 8, the pressure in the pneumatic buffer is subject to variations, with a characteristic peak pressure occurring at the time when the drive piston 8 and the percussion piston 11 are closest together. The integral of the pressure gradient in the buffer ensures that the membrane 24 is pressed downwardly against the stop 25. In this position of the membrane 24, the throttle valve 28 is held in the position which establishes the largest flow cross-section through the tubular member 29, due to the power output of the percussion piston, the engine 5 provides the on-load speed in spite of the high mixture supply.

Figure 2:
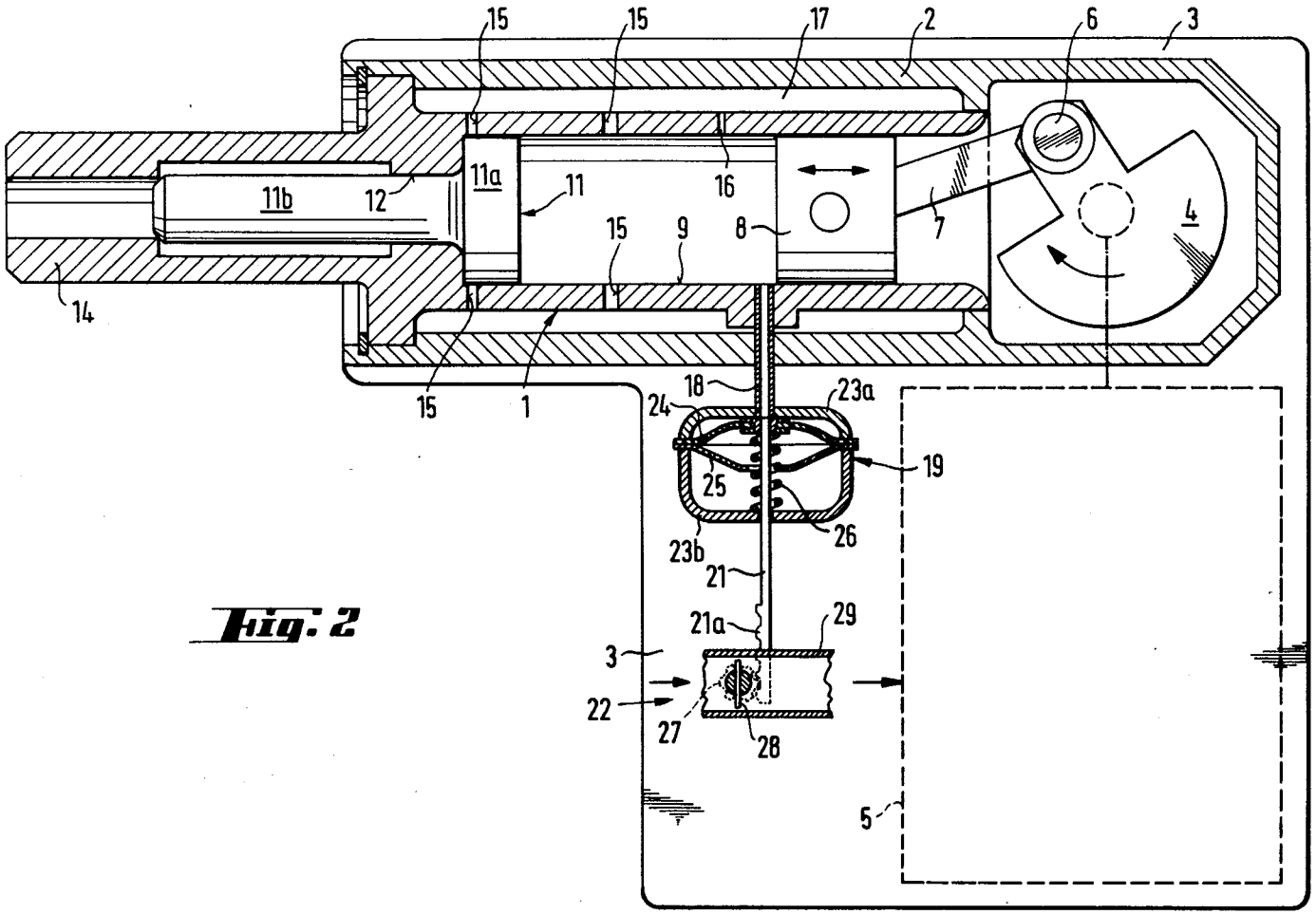
FIG. 2 is a view similar to FIG. 1, however, with the percussion piston in its rest position.

If the tool 13 is removed from the hammer drill, as shown in FIG. 2, the percussion piston moves to its forwardmost position in the cylinder bore 9. In this position, the buffer which moves the percussion piston 11 is dissipated, since the space between the head 11*a* and the driving piston is connected to the annular space 17 through the bores 15 so that a continuous exchange of air takes place. The pressure in the cylinder bore between the two pistons corresponds to the atmospheric pressure, accordingly, there is no longer any pressure acting on the membrane 24 sufficient to displace it against the stop 25. On the contrary, the biasing action of the compression spring 26 now moves the membrane toward the upper surface of the half-shell 3*a*. This movement of the membrane and the push rod 21 connected to it causes the throttle valve to be moved throttling the flow of the mixture so that the speed of the engine is not higher than that of the on-load speed even though the percussion action is no longer effective and, therefore, the power requirement is reduced.

If a tool 13 is inserted into the tool holder 14 with the hammer drill in the condition shown in FIG. 2, the percussion piston 11 is moved rearwardly from its forwardmost rest position toward the drive piston 8 and the pneumatic buffer is again created between the two pistons. During operation, the percussion piston 11 is once again reciprocated with its phase shifted relative to the drive piston 8. Since the motor had previously only operated at relatively low on-load speeds, placing the percussion piston 11 back in operation does not result in any peak loads which would damage the hammer drill.

While specific embodiments of the invention have been shown and described in detail to illustrate the application of the inventive principles, it will be understood that the invention may be embodied otherwise without departing from such principles.

What is claimed is:

1. Hammer drill comprising an axially elongated cylinder having a first end and a second end, a drive piston located within said cylinder and located adjacent the first end thereof, a drive motor, means connected to said drive motor and said drive piston for reciprocating said drive piston back and forth in said cylinder, a percussion piston located within said cylinder in spaced relation with said drive piston and located between the second end of said cylinder and said drive piston, a tool holder connected to said cylinder for holding a tool to be driven by said percussion piston, said drive piston and percussion piston forming a pneumatic buffer therebetween when a tool is placed in said tool holder and said drive piston is driven by said drive motor, wherein the improvement comprises first means for controlling the operation of said drive motor, and second means in communication with the pneumatic buffer and connected to said first means for regulating said first means based on the pressure conditions existing in the pneumatic buffer.

2. Hammer drill, as set forth in claim 1, wherein said drive motor is an internal combustion engine, said first means comprises a throttle valve for controlling the flow of a fuel-air mixture to said drive motor, and said second means comprises an adjusting element connected to said throttle valve for controlling the flow of the fuel-air mixture to said drive motor.

3. Hammer drill, as set forth in claim 2, wherein said adjusting element comprises a membrane switch, said membrane switch comprises a housing, a membrane supported within and dividing the interior of said housing into a first chamber and a second chamber, a tubular member extending between said first chamber and said cylinder and being open during at least a part of the reciprocating cycle of said drive piston to the pneumatic buffer within said cylinder, and a connecting rod secured to said membrane and to said throttle valve.

4. Hammer drill, as set forth in claim 3, wherein said drive piston being reciprocally movable over the connection of said tubular member to said cylinder so that said drive piston forms a closure of said tubular member during a portion of its reciprocating motion.

5. Hammer drill, as set forth in claim 3, wherein said membrane switch includes a compression spring located within said housing and acting against said membrane for biasing said membrane in opposition to the pressure active within the pneumatic buffer.

6. Hammer drill, as set forth in claim 1, wherein a jacket tube laterally encloses said cylinder and forms in combination with said cylinder an axially extending closed annular space therebetween, openings through said cylinder intercommunicating between the interior of said cylinder and the annular space for preventing the formation of an air cushion.

7. Hammer drill, as set forth in claim 1, wherein said first means comprises a control member for said drive motor, and said second means comprises an adjusting element connected to said control member for operating said control member.

8. Hammer drill, as set forth in claim 7, wherein said adjusting element is a membrane switch.

* * * * *